United States Patent [19]

Platt

[11] Patent Number: 4,569,216

[45] Date of Patent: Feb. 11, 1986

[54] SEQUENTIAL VARIABLE PITCH COILER

[75] Inventor: Stephen A. Platt, Grand Haven, Mich.

[73] Assignee: S. A. Platt, Inc., Grand Haven, Mich.

[21] Appl. No.: 699,338

[22] Filed: Feb. 7, 1985

[51] Int. Cl.[4] ..... B21F 3/04

[52] U.S. Cl. ..... 72/138; 72/143; 72/145

[58] Field of Search ..... 72/135, 138, 142, 143, 72/144, 145; 140/124

[56] References Cited

U.S. PATENT DOCUMENTS

| | | | |
|---|---|---|---|
| 432,741 | 7/1890 | Spuhl | 72/138 X |
| 1,930,329 | 10/1933 | Vinar | 72/138 X |
| 2,371,782 | 3/1945 | Sirp | 72/144 X |
| 2,650,638 | 9/1953 | Johnson et al. | 72/143 |
| 3,007,510 | 11/1961 | De Prado | 72/138 |
| 3,401,557 | 9/1968 | Platt | 72/145 |
| 4,205,543 | 6/1980 | Wright | 72/138 |
| 4,208,896 | 6/1980 | Platt | 72/142 |
| 4,258,561 | 3/1981 | Platt | 72/142 |

FOREIGN PATENT DOCUMENTS

| | | | |
|---|---|---|---|
| 852998 | 3/1940 | France | 72/138 |
| 566178 | 9/1975 | Switzerland | 72/138 |

*Primary Examiner*—E. Michael Combs

*Attorney, Agent, or Firm*—Price, Heneveld, Huizenga & Cooper

[57] ABSTRACT

A wire coiling machine for pattern forming resistance wire coils with controlled spacing of the turns, one of the two forming rolls being axially shiftable relative to the other by an actuator motor, the coiling rolls each having a surface configuration specially grooved to retain the coiling wire during axial shifting of the roll, but still allowing escape of the wire as it is formed into a coil.

23 Claims, 7 Drawing Figures

SEQUENTIAL VARIABLE PITCH COILER

BACKGROUND OF THE INVENTION

This invention relates to coiling machines, particularly for pattern or program coiling of resistance wire into coils with periodic close winding and space winding portions.

Coils of resistance wire, used largely for heating elements, instrumentation and the like, are formed from wire on helical coiling machines such as those disclosed in U.S. Pat. Nos. 4,258,561 and 4,208,896 and application Ser. No. 652,509 filed Sept. 20, 1984. Sometimes it is desirable to have such coils possess portions of closely wound turns and intermittent portions of spaced turns. Heretofore, the only practical technique believed to be used to produce coils having both such close and space winding, i.e. known as pattern coiling or program coiling, has been to insert a thin blade into the spinning coil between the turns to spread the wire turns where spacing is needed. The spacing achieved by this technique is limited to a dimension which is approximately equal to one wire thickness at a maximum. Attempting greater spacing results in the spinning coil buckling and destroying itself. Thus, any greater spacing must be laboriously achieved using manual jigs and fixtures.

It should be understood that coiling, including space coiling, of spring wire is basically different than coiling of resistance wire. Spring wire can be pushed against a fixed curve tungsten carbide forming block to coil it. Thus, by simply moving the block in relation to the incoming end or point of wire, practically any pattern of spring coiling can be readily produced. But, resistance wire must be pulled to coil it, not pushed. Thus, resistance wire coiling machines use a rotating coiling arbor and adjacent coiling rolls cooperative therewith. The temper of resistance wire is only a fraction of that of spring wire. Being typically an alloy of high chrome and nickel content, the wire is subject to molecular marriage, i.e. "cladding", which takes place if the wire is pushed against any fixed surface with pressure sufficient to form a coil, thereby destroying the constant resistance of the wire and hence the usefulness of the coil itself. Therefore, space coiling of resistance wire has been somewhat difficult to achieve and definitely limited in results.

It would be advantageous to be able to space coil right on a coiling machine as the coil is being formed, to a spacing significantly greater, even many times greater, than the diameter of the wire strand, and/or to readily vary the spacing of a coil as it is formed, and/or to pattern or program coil to controlled intermittent close and space coiling as the coil is formed on the arbor of the coiling machine.

SUMMARY OF THE INVENTION

The present invention provides a resistance wire coiling machine capable of achieving controlled spacing of the coil turns an amount up to several times the diametral thickness of the wire, right as the coil is being formed on the arbor. The spacing can be varied as needed. The coil being formed can be pattern coiled into periodic portions of controlled close and spaced coiling turns, just as rapidly as the high speed machine produces the coil.

The machine controllably shifts one of the coiling rolls axially relative to the other coiling roll, taking with it the wire being fed to the arbor. The helix angle of feed to the arbor is changed, as well as the space between resulting wire turns. The coiling rolls are specially configurated to retain engagement with the shifted infeeding wire during shifting of the one forming roll, yet to allow escape of the wire after it is formed into the coil. The rate of wire feed automatically changes to accommodate the different helix. The rate of rotation of one of the forming rolls around which the wire is fed to the arbor changes to accommodate the different rate of wire feed. This forming roll is not power driven from a rear drive roll like the other forming roll is, being free to instantly change rotational speed, either increasing with the start of space winding, or decreasing with the start of close winding. Moreover, the degree of space winding, i.e. the helix angle and spacing of turns, may also be varied controllably.

These and other features and advantages will be apparent upon review of the following detailed description along with the drawing figures.

DESCRIPTION OF THE PREFERRED EMBODIMENT

Figure 1:
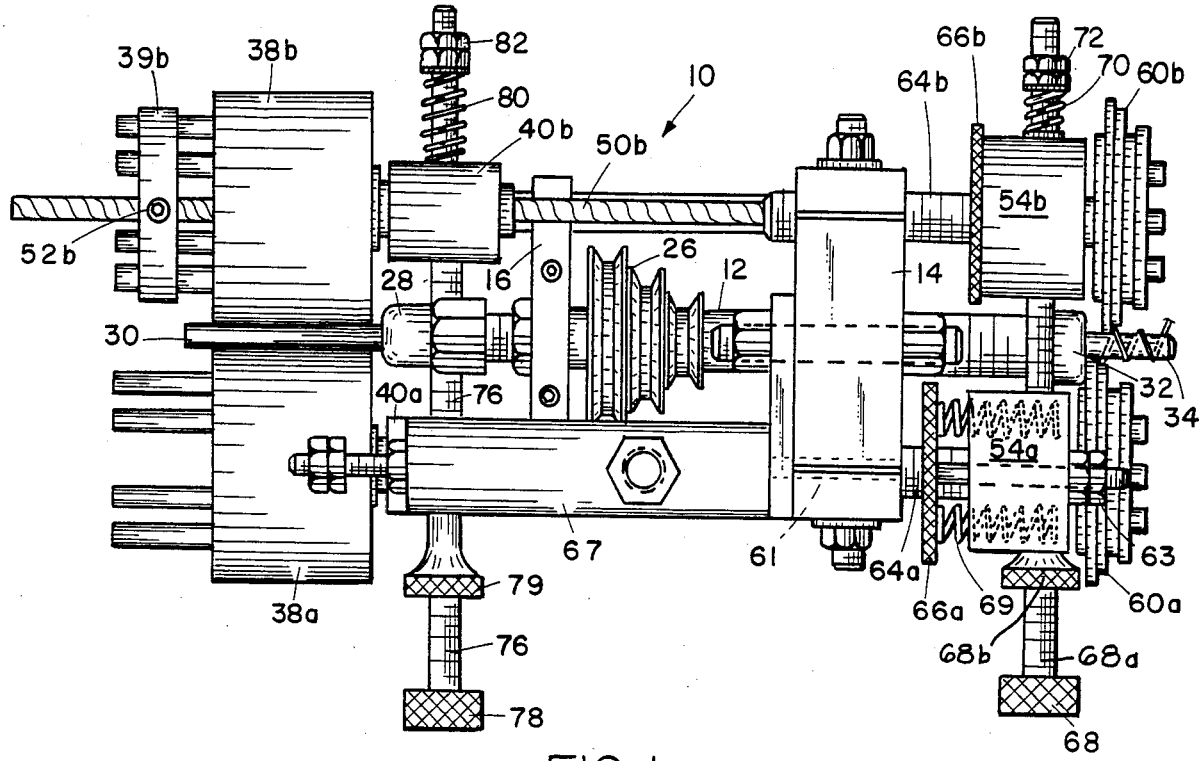
FIG. 1 is a top plan view of the coiling machine of this invention.
Figure 2:
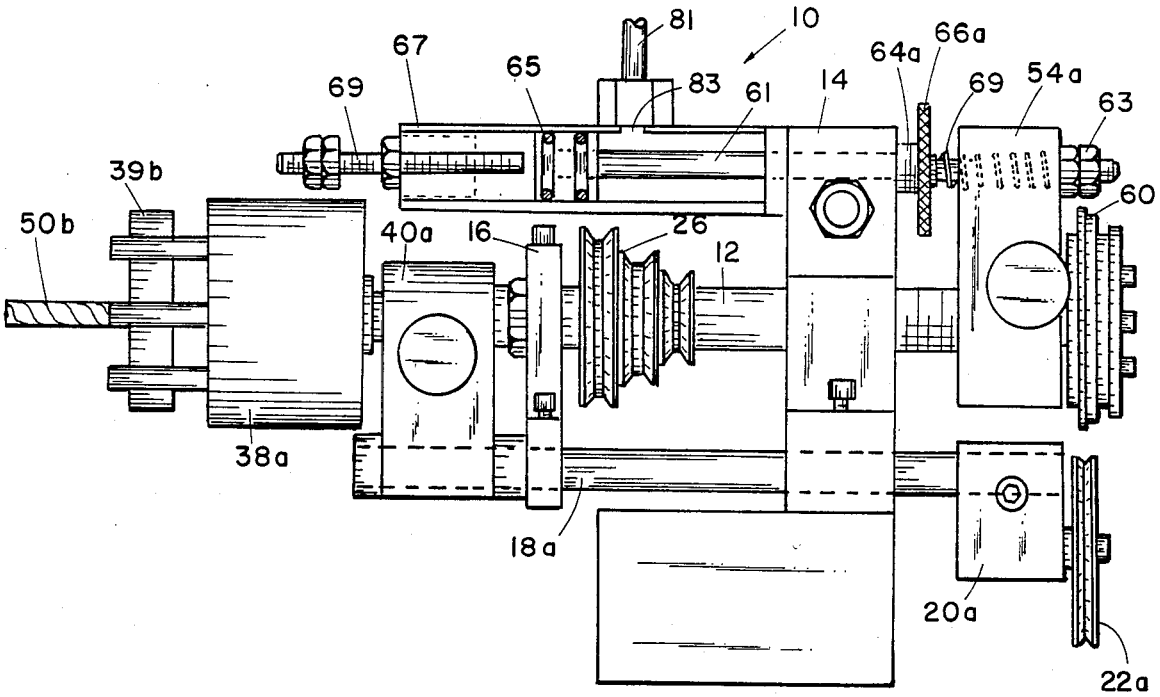
FIG. 2 is a side elevational view of the coiling machine in FIG. 1.
Figure 3:
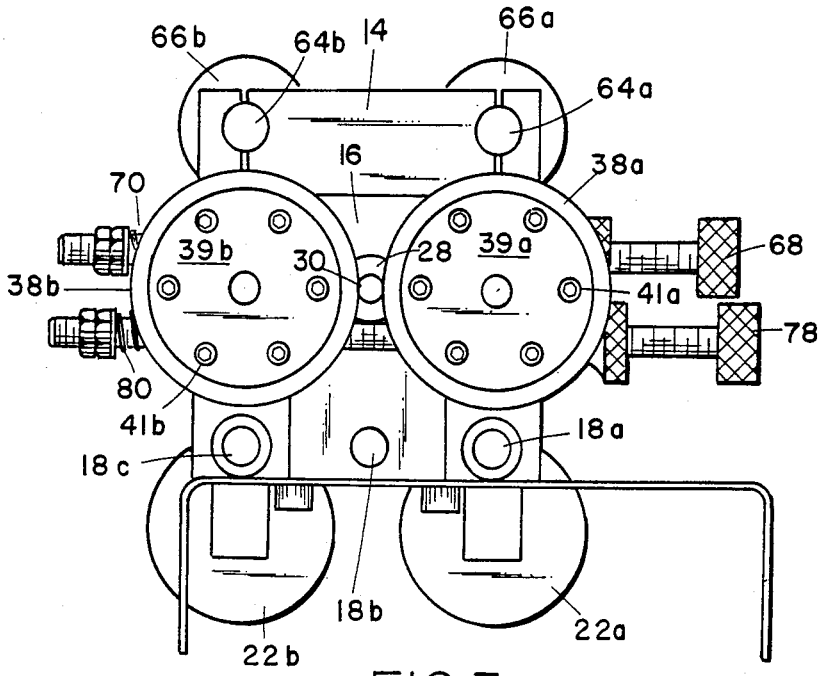
FIG. 3 is a rear elevational view of the coiling machine.
Figure 4:
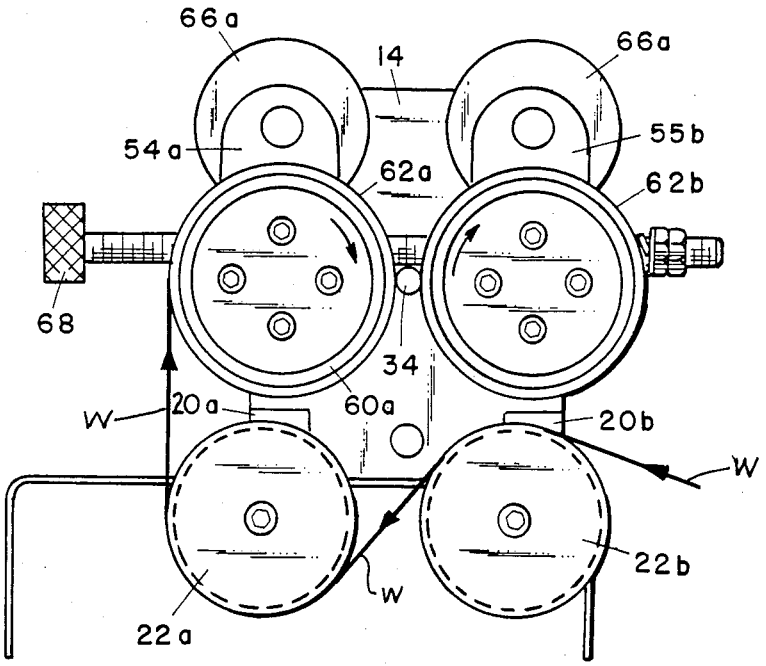
FIG. 4 is a front elevational view of the coiling machine.
Figure 6:
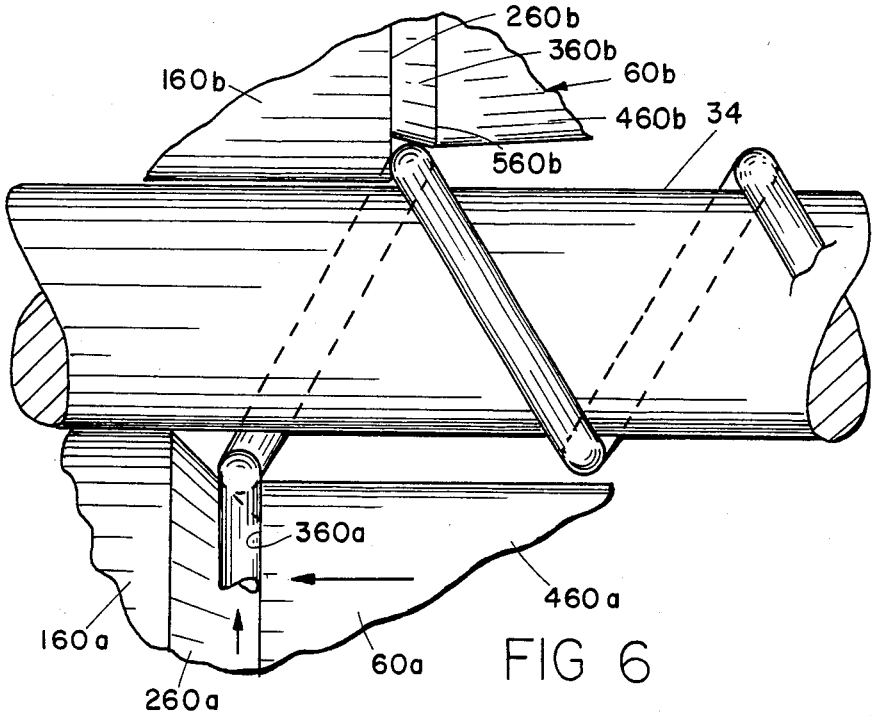
FIG. 6 is a greatly enlarged, top plan view of the apparatus in FIG. 5, showing a space coil portion being formed.
Figure 7:
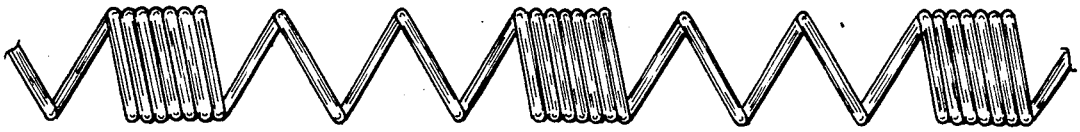
FIG. 7 is an elevational view of an exemplary resistance wire coil having a pattern or program of close wound portions and intermediate space wound portions.

FIGS. 1–6 disclose the presently preferred embodiment of this invention, with FIG. 7 showing an exemplary coil formed thereon. As the apparatus is depicted in FIGS. 1 and 2, the left portion of the apparatus is the drive portion, while the right portion is the coil forming portion.

The coiling machine 10 is centered about a central drive shaft 12 mounted in bearings in support block 14 and rearwardly spaced block 16. These are connected by three fixed tie rods 18*a*, 18*b* and 18*c*. The forward ends of these tie rods project past block 14 to enable a pair of hangers 20*a* and 20*b* to be suspended thereon for mounting the wire feed pulleys 22*a* and 22*b* of conventional type and shown for example in U.S. Pat. No. 3,359,768 incorporated by reference herein.

Mounted on drive shaft 12 is one or more drive pulleys 26, here shown to be three in number and of differing diameters to allow a selected rotational speed of the drive shaft during operation. A suitable drive belt from a motorized source (not shown) engages the pulley. At the rear end of drive shaft 12 is a chuck 28 which retains a rearwardly projecting drive arbor 30. At the forward end of drive shaft 12 is another chuck 32 which retains a forwardly projecting front coiling arbor 34.

Astraddle the rear drive arbor 30 is a pair of rolls 38*a* and 38*b* mounted on the respective axle shafts, having a bearing support within the upper portions of a pair of upstanding pivotal mounting blocks 40*a* and 40*b*. The lower ends of these mounting blocks are pivotally attached to the rear end portions of rods 18*a* and 18*c*. Thus, rolls 38*a* and 38*b* are indirectly mounted upon these pivot rods, basically with the centerline of the mass of the rolls in the same vertical plane as the axis of the pivot rods. The periphery of these rolls constitutes a high friction material such as neoprene rubber for optimum drive engagement with the small diameter steel drive arbor 30 therebetween. Roll 38*b* serves as a drive roll through flexible shaft 50*b* as described hereinafter, while roll 38*a* serves as a stress balancing roll on the opposite side of small diameter drive arbor 30. Roll 38*a* is not drivingly connected to the front of the machine with a flexible shaft as roll 38*b* is, for reasons to be explained hereinafter.

To the rear of roll 38*b*, axially aligned therewith, is a drive ring 39*b* secured by a plurality of connectors 41*b* to the drive roll 38*b*. Ring 39*b* is also attached to the rear end of flexible cable drive shaft 50*b* as by set screw 52*b* (FIG. 1). This flexible drive shaft extends forwardly through drive roll 38*b*, block 40*b*, and through front hanger 54*b*, to the forming or coiling roll 60*b*. Hanger bracket 54*b* has its upper end pivotally attached to an extension bearing on hollow threaded support rod 64*b*. Rod 64*b* in turn is threadably attached to block 14. This rod is axially adjustable with respect to block 14, manually, by knurled ring 66*b*. Forming roll 60*a* is on the opposite side of forming arbor 34 from roll 60*b*, in straddling relationship. Roll 60*a* is freely rotatably mounted on a bearing at the lower end portion of hanger 54*a*. Hanger 54*a* is pivotally suspended on the outer forward end of a piston rod 61 extending through threaded rod 64*a*. Rod 64*a* is threadably engaged with block 14. Knurled ring 66*a* is secured to threaded rod 64*a*. Piston rod 61 is axially and pivotally movable inside rod 64*a*. Hanger 54*a* is held on piston rod 61 as by nuts 63 attached on the outer threaded end of rod 61. Rod 61 also extends rearwardly through block 14 to its attached piston 65 in a fluid cylinder actuator 67. Controlled supply of a pressurized fluid from a suitable source (not shown) through conduit 81 and inlet port 83 to the forward end of cylinder 67 causes cylinder actuation by rearward pressure on piston 65. Actuation of cylinder 67 retracts rod 61 and hanger 54*a* to the rear. In the embodiment depicted, the mechanism is spring returned upon release of pressurized fluid to cylinder 67. A set of compression coil springs 69 is located between the outer axial face of ring 66*a* on one end of the springs, and hanger 54*a* on the other end of the springs, to be compressed with cylinder actuation, and thereby to cause return of the hanger and forming roll to the initial axial position upon deactuation of the cylinder. The rearwardly shifted position of the mechanism is determined by the location of threaded stop 69 axially extending into the rear of the cylinder and threadably adjustable along the axis. It can be varied manually to the desired axial location. The piston abuts this stop when shifted rearwardly under fluid pressure in the cylinder.

Figure 5:
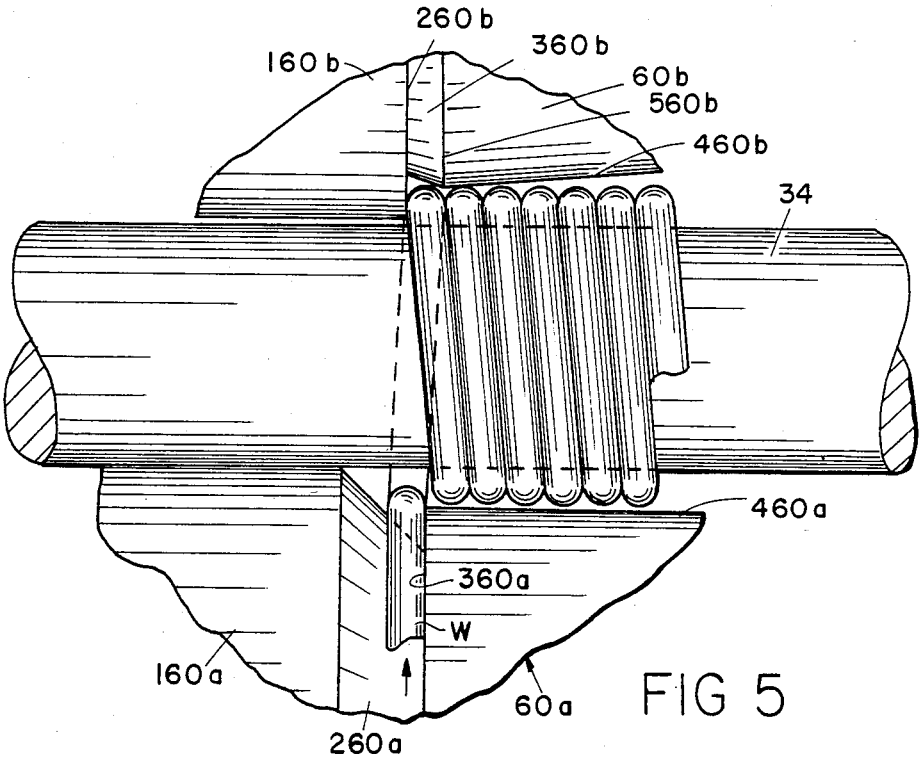
FIG. 5 is a greatly enlarged, fragmentary, plan view of the coil forming portion of the machine showing a close coil being formed.

This shifting function of the one forming roll axially rearwardly with respect to the second forming roll, and return thereof, enable controlled close or space coiling of the wire while the coil is being formed on arbor 34. In the forward position, roll 60*a* is axially positioned slightly rearwardly of roll 60*b*, less than the thickness of the wire being coiled. In this condition, a close coil is formed with the adjacent wire turns in engagement with each other (FIG. 5). In the rearwardly shifted position of the first roll 60*a*, however, space coiling is performed (FIG. 6). That is, the helix angle is enlarged, with the adjacent turns not being in engagement with each other but being spaced from each other. The changeover from close coiling to space coiling and back again can be practically instantly achieved while the high speed coiling is occurring. The rolls 60*a* and 60*b* are specially configured as described in detail hereinafter to retain the wire being fed to the arbor, i.e. to cause the wire to remain in its proper position on the periphery of the rolls, and not escape, when the shift is made. Yet, the configuration does allow the wire to release from the rolls and escape after it forms into a turn of the coil, enabling controlled advancement along the arbor to discharge of the coil from the free end of the arbor.

The absence of a drive shaft to forming roll 60*a*, with this roll having a free wheeling characteristic, accommodates the different wire feed speed to the forming arbor with the change in the type of coiling. Specifically, the amount of wire being fed to the arbor is increased significantly with an increase in helix angle of the coil being formed. Thus, when a close coil is being formed, the amount of wire to make one turn of the coil equals only slightly more than the peripheral circumference of the arbor because the helix angle is close to zero. However, with shifting of roll 60*a* rearwardly to space wind, the helix angle increases substantially so that the amount of wire required for one turn is increased. The rotational speed of free wheeling roll 60*a* over which the wire is being fed increases by the pull of the wire due to friction to accommodate this increased rate of wire feed.

Forming rings 60*a* and 60*b* are biased toward forming arbor 34 by use of transverse threaded shaft 68*a* having a knurled knob 68 on one end, extending through hangers 54*a* and 54*b*, and having a compression spring 70 and retention nuts 72 on the opposite end. Adjustment of this threaded shaft and knurled lock nob 68*b* allows variation of the biasing pressure applied by the spring, uniformly on both hangers, and therefore uniformly on the forming rolls against arbor 34.

A similar threaded biasing rod arrangement extends between mounts 40*a* and 40*b* for rolls 38*a* and 38*b*, i.e. threaded rod 76 having a knurled knob 78 and a knurled lock knob 79, spring 80 and retention nuts 82 on the opposite end thereof, for controlled balanced biasing of these rolls against drive arbor 30.

The diameter of the rear drive arbor 30 is essentially the same as the outer diameter of the wire coil being formed around forming arbor 34, i.e., the diametral spacing between the forming rolls 60*a* and 60*b*. The diameter of the front coiling arbor 34 is essentially the same as the internal diameter of the coil being formed. The diameter of rolls 38*a* and 38*b* is essentially the same as the diameter of the forming rolls 60*a* and 60*b*.

The peripheral configuration of rolls 60*a* and 60*b* is shown in the enlarged drawings, FIGS. 5 and 6. FIG. 5 depicts close coiling, while FIG. 6 depicts space coiling. Roll 60*a*, the first roll over which the wire is fed to the apparatus, (see wire W in FIG. 4), includes a forward portoon 460*a* and a rearward portion 160*a*. These may be separate elements secured together and called a forming ring and a backup ring, or may simply be part of the same unitary structure. Between these two portions is an incoming groove for the incoming wire, having a sharp shoulder 360*a*, facing axially rearwardly of the structure and basically normal to the axis of the rolls and arbor, cooperative with the bottom 260*a* of the groove which tapers axially rearwardly toward arbor 34. The shoulder 360*a* and groove bottom 260*a* receive wire W so that the edge of shoulder 360*a* is below the equator, i.e. max diameter portion of wire W. Thus, the wire W being fed over the roll will be retained in this groove whether the roll is in its forward position (FIG. 5), whether it is in its rearward position (FIG. 6), or even while it is being shifted to the rear during which time there is the maximum tendency for the wire to try to escape this groove. The periphery of portion 460*a* is small enough to prevent contact with the discharging turns of the wire coil advancing along forming arbor 34.

The second forming roll 60*b* also includes a forward portion 460*b*, a rearward portion 160*b* forming a backup, and a groove between these two portions including shoulder 260*b* facing axially forwardly toward the discharge end of the arbor, and basically normal to the axis of the forming rolls and arbor, as well as a slanted groove bottom 360*b* cooperative therewith. The diameter of portion 160*b* is sufficiently great so that shoulder 260*b* extends past the equator, i.e. largest diameter portion, of the wire, totally preventing rearward movement of the wire. Portion 460*b* slopes away from the arbor, toward the discharge end, at a small taper angle of approximately one-half degree. The slope of surface 360*b* is approximately fifteen degrees, relative to the axis of rotation. Between these two sloped portions is a peripheral apex 560*b* spaced from arbor 34 the thickness of the wire being formed. The slight taper of surface 460*b* allows smooth feeding of the coil along arbor 34 to the discharge end.

During the coiling operation, two forces turn the first forming roll 60*a*. Wire passing over a portion of its periphery supplies one turning force. Secondly, the biased relationship of the forming rolls against arbor 34 causes driven arbor 34 to provide a gentle or small amount of turning power on forming roll 60*a*. However, this second rotational force is small enough that the peripheral speed of forming roll 60*a* will quickly change relative to the peripheral speed of the arbor to match the changed speed of the wire. Therefore, forming roll 60*a* can readily accommodate different wire infeed speeds as necessary for the coil being formed.

The second forming roll 60*b* is under power and basically does the actual coiling. Its sharp rear shoulder 260*b* establishes the fixed point where wire begins to coil and maintains this even when the front roll is shifting wire to the left for space winding. The sloped shoulder or surface 360*b* constitutes a honed corner just sufficient to keep the first upcoming wire locked against the shoulder. It also maintains this relationship as the coiling is instantly shifted from space coiling to close coiling, preventing the turns of wire from running away from the shoulder. The one-half degree tapered surface 460*b* permits slight expansion of each successive turn of wire over the arbor sides for smooth horizontal flow off of the finished coil.

OPERATION

In operation of this apparatus, a suitable motor and belt drive pulley 26 on the main drive shaft, causing both the front and rear arbors to spin at a high speed. Spinning of rear drive arbor 30 causes the straddling engaging rolls 38*a* and 38*b* to rotate, such that roll 38*b* drives flexible drive shaft 50*b* and hence the front forming roll 60*b*. The peripheral speed of roll 60*b* is essentially the same as the peripheral speed of drive roll 38*b*. This peripheral speed therefore is the same as the peripheral outer diameter speed of the coil being formed around arbor 34. The wire is fed over feed pulley 22*b* (see FIG. 4) and then around a peripheral portion of feed pulley 22*a* to the peripheral portion of formin roll 60*a* opposite forming arbor 34. It then follows the groove on roll 60*a*, being pulled up over the top of roll 60*a* and pulled onto forming arbor 34 and into engagement with the groove of roll 60*b* while being configured into a series of adjacent turns advanced along the arbor toward its discharge end. In forming a close coil, the groove of forming roll 60*a* is spaced just to the rear of the groove of roll 60*b* an amount less than the thickness of the wire diameter (FIG. 5) to cause the successive turns of wire to be in engagement with each other. When it is desired to space coil the wire, fluid cylinder 67 is actuated to retract its piston and piston rod 61, thereby drawing the hanger 54*a* and forming roll 60*a* to the rear until the piston abuts threaded stop 69. When pattern or program coiling is performed, to obtain intermittent space coiling portions and intermittent close coiling portions, an automatic controller such as a digital controller is preferably employed. When the shift of roll 60*a* is made, the special configuration of roll 60*a*, and particularly shoulder 360*a*, retains the wire W being fed, the groove then being positioned rearwardly of the backup shoulder of roll 60*b* a selected amount up to several times the wire diameter thickness (see FIG. 6). At this increased helix angle, the amount of wire fed over roll 60*a* is increased, with the peripheral speed of roll 60*a* being immediately increased by frictional wire engagement to accommodate it. By alternately close coil and space coil winding, a pattern coil of the type for example in FIG. 7 can be readily formed. This entire operation occurs rapidly, dependably, and with many potential variations. No manual forming is necessary.

Conceivably, minor vibrations might be made in the specific form of the apparatus depicted and considered to constitute the preferred embodiment of my invention. Hence, it is intended that the invention is not to be limited to this illustrated embodiment, but only by the scope of the appended claims and the reasonable equivalents to those defined therein.

The embodiments of the invention in which an exclusive property or privilege is claimed are defined as follows:

1. A wire coiling machine for forming coils of controlled spacing of wire turns comprising:

a rotational arbor shaft having a forming arbor at a front end and a drive arbor at a rear end thereof;

a rear drive roll adjacent said drive arbor for engagement therewith;

first and second front forming rolls astraddle said forming arbor;

a drive connection between said drive roll and said second forming roll for causing said second drive roll to rotate said second forming roll; and axial shifting means for causing limited axial shifting of said first forming roll with respect to said second forming roll during coiling of said wire on said forming arbor to create controlled spacing between adjacent turns of wire being coiled on said forming arbor.

2. The wire coiling machine of claim 1 including another rear roll on the opposite side of said drive arbor from said rear drive roll, with said front forming roll being free of a drive connection to said other rear roll to be free-wheeling.

3. The wire coiling machine of claim 2 wherein said axial shifting means comprises a motor.

4. The wire coiling machine of claim 3 wherein said motor is a fluid cylinder.

5. The wire coiling machine of claim 4 including controlled stop means for controlling the amount of axial shifting of said first forming roll.

6. The wire coiling machine of claim 1 including controlled stop means for controlling the amount of axial shifting of said first forming roll.

7. The wire coiling machine of claim 1 wherein said first and second forming rolls are configured to axially retain the wire being coiled, even during axial shifting of said first forming coil with respect to said second forming coil.

8. The wire coiling machine of claim 7 wherein said first and second forming rolls each has a configurated groove for the temporary axial retention of the wire during infeed and coiling thereof.

9. The wire coiling machine of claim 8 wherein the groove on said second forming roll has a backup shoulder generally normal to the axis of said forming arbor, and a tapered bottom convergent toward said forming arbor in the direction of discharge of the coil from said forming arbor.

10. The wire coiling mechine of claim 9 wherein the angle of taper of said bottom surface is about fifteen degrees.

11. The wire coiling machine of claim 9 wherein said groove on said second forming roll has a width about that of the diameter of the wire being coiled.

12. The wire coiling machine of claim 9 wherein the surface of said second forming roll tapers away from said forming arbor from the edge of said groove on said second forming roll, to allow the coiled wire to be controllably advanced along said forming arbor.

13. The wire coiling machine of claim 12 wherein the angle of taper of said surface is about one-half degree.

14. The wire coiling machine of claim 9 wherein the groove on said first forming roll has a tapered bottom divergent away from said forming arbor in the direction of discharge of the coil from said forming arbor, and has a retention shoulder oriented toward said direction of discharge, said retention shoulder being generally normal to the axis of said forming arbor.

15. The wire coiling machine of claim 14 wherein said retention shoulder is dimensioned to engage the forming wire short of its equator diameter, to prevent escape of the wire if said first forming roll is axially shifted, but to allow escape of the wire as it is coiled.

16. The wire coiling machine of claim 1 including a hanger supporting said first forming roll; said axial shifting means being operably associated with said hanger for shifting said hanger and thereby said first forming roll axially relative to said second forming roll.

17. The wire coiling machine of claim 16 wherein said shifting means comprises a fluid motor and spring return.

18. The wire coiling machine of claim 16 wherein said shifting means when actuated, axially moves said hanger and said first forming roll away from said second forming roll in a direction opposite the direction of discharge of the wire coil being formed.

19. A wire coiling machine comprising:

a rotational forming arbor and a pair of first and second arbor-straddling forming rolls;

means for rotationally driving said forming arbor;

means for feeding incoming wire over a peripheral portion of said first forming roll onto said arbor and into engagement between said arbor and said second forming roll for coiling of the wire;

said first forming roll being free-wheeling;

means for rotationally driving said second forming roll;

axial shifting means for controllably shifting said first forming roll with respect to said second forming roll and said arbor during coiling of said wire on said forming arbor; and said forming rolls being configured to retain said wire in feeding and coiling relation thereto during said shifting.

20. The wire coiling machine of claim 19 wherein said first and second forming rolls each has a configurated groove for the temporary axial retention of the wire during infeed and coiling thereof.

21. The wire coiling machine of claim 20 wherein the groove on said first forming roll has a tapered bottom divergent away from said forming arbor in the direction of discharge of the coil from said forming arbor, and has a retention shoulder oriented toward said direction of discharge, said retention shoulder being generally normal to the axis of said forming arbor.

22. The wire coiling machine of claim 21 wherein the groove on said second forming roll has a backup shoulder generally normal to the axis of said forming arbor, and a tapered bottom convergent toward said forming arbor in the direction of discharge of the coil from said forming arbor.

23. The wire coiling machine in claim 22 wherein said retention shoulder is dimensioned to engage the forming wire short of its equator diameter to prevent escape of the wire if said first forming roll is axially shifted, but to allow escape of the wire as it is coiled.

* * * * *

UNITED STATES PATENT AND TRADEMARK OFFICE

CERTIFICATE OF CORRECTION

PATENT NO. : 4,569,216

DATED : February 11, 1986

INVENTOR(S) : Stephen A. Platt

It is certified that error appears in the above-identified patent and that said Letters Patent is hereby corrected as shown below:

Column 6, line 7:
"formin" should be --forming--.

Column 6, line 39:
"vibrations" should be --variations--.

Column 7, claim 10, line 29:
"mechine" should be --machine--.

Signed and Sealed this

*Fifteenth* Day of *July 1986*

[SEAL]

*Attest:*

DONALD J. QUIGG

*Attesting Officer*

*Commissioner of Patents and Trademarks*